US012050065B2

(12) United States Patent
Streiff

(10) Patent No.: US 12,050,065 B2
(45) Date of Patent: Jul. 30, 2024

(54) TUBE-BUNDLE HEAT EXCHANGER COMPRISING ASSEMBLIES/BUILT-IN ELEMENTS FORMED OF DEFLECTION SURFACES AND DIRECTING SECTIONS

(71) Applicant: Sulzer Management AG, Winterthur (CH)

(72) Inventor: Felix Streiff, Humlikon (CH)

(73) Assignee: SULZER MANAGEMENT AG, Winterthur (CH)

( * ) Notice: Subject to any disclaimer, the term of this patent is extended or adjusted under 35 U.S.C. 154(b) by 64 days.

(21) Appl. No.: 17/613,593

(22) PCT Filed: May 26, 2020

(86) PCT No.: PCT/EP2020/064519
§ 371 (c)(1),
(2) Date: Nov. 23, 2021

(87) PCT Pub. No.: WO2020/239734
PCT Pub. Date: Dec. 3, 2020

(65) Prior Publication Data

US 2022/0236014 A1 Jul. 28, 2022

(30) Foreign Application Priority Data

May 28, 2019 (CH) ..... 00696/19

(51) Int. Cl.
*F28F 9/22* (2006.01)
*F28D 7/00* (2006.01)
(Continued)

(52) U.S. Cl.
CPC ..... *F28D 7/1615* (2013.01)

(58) Field of Classification Search
CPC ..... F28D 7/005; F28D 7/06; F28D 7/1607; F28F 9/013; F28F 9/0131;
(Continued)

(56) References Cited

U.S. PATENT DOCUMENTS 1,505,429 A * 8/1924 Ripley ..... F28F 9/22 165/DIG. 417
3,400,758 A * 9/1968 Lee ..... F28F 9/22 159/901
3,566,961 A * 3/1971 Lorenz ..... B01J 8/062 165/104.31
4,314,606 A 2/1982 Muller et al.
(Continued)

FOREIGN PATENT DOCUMENTS

DE 2839564 A1 3/1980
EP 1067352 A1 10/2001
(Continued)

OTHER PUBLICATIONS

International Search Report issued Aug. 28, 2020 in corresponding International Application No. PCT/EP2020/064519.

*Primary Examiner* — Frantz F Jules
*Assistant Examiner* — Jason N Thompson
(74) *Attorney, Agent, or Firm* — GLOBAL IP COUNSELORS, LLP

(57) ABSTRACT

A tube-bundle heat exchanger includes built-in elements formed by deflection surfaces, windows and directing sections. The product flows in the outer chamber of a tube-bundle heat exchanger with an inlet and an outlet for the product and an inlet and an outlet for the heat carrier medium in the tubes. The deflection panels including the tube-bundle heat exchanger are modified such that they leave windows open and a directing section is attached on the inlet side and the outlet side of the deflection surface. These directing sections run parallel to the tube axes and cross one another. The flow is divided by the direction sections on the inlet side and directed to the windows in
(Continued)

opposing directions, where it then exits on respective opposing sides of the outlet sections and is deflected.

14 Claims, 10 Drawing Sheets

(51) Int. Cl.
*F28D 7/06* (2006.01)
*F28D 7/16* (2006.01)
*F28F 9/013* (2006.01)

(58) Field of Classification Search
CPC ..... F28F 2009/222; F28F 2009/223; F28F 2009/226; F28F 9/22
USPC ..... 165/161, 162
See application file for complete search history.

(56) References Cited

U.S. PATENT DOCUMENTS

| | | | | |
|---|---|---|---|---|
| 5,217,066 | A * | 6/1993 | Killebrew | F28F 9/00 165/161 |
| 2003/0226654 | A1 | 12/2003 | Gohna | |
| 2009/0301699 | A1* | 12/2009 | Karrs | F28F 9/22 165/159 |
| 2014/0262172 | A1 | 9/2014 | Ljubicic | |
| 2016/0025413 | A1* | 1/2016 | Ernst | F28D 7/0083 165/172 |

FOREIGN PATENT DOCUMENTS

| | | | | |
|---|---|---|---|---|
| EP | 3029407 | A1 | 8/2016 | |
| JP | 09000901 | A * | 1/1997 | B01F 5/0641 |
| WO | WO-2018026312 | A1 * | 2/2018 | F25B 39/04 |

* cited by examiner

TUBE-BUNDLE HEAT EXCHANGER COMPRISING ASSEMBLIES/BUILT-IN ELEMENTS FORMED OF DEFLECTION SURFACES AND DIRECTING SECTIONS

CROSS-REFERENCE TO RELATED APPLICATIONS

This application is a U. S. National Stage application of International Application No. PCT/EP20201064519, filed May 26, 2020, which claims priority to Swiss Patent Application No. 00696/19, filed May 28, 2019, the contents of each of which are hereby incorporated by reference.

BACKGROUND

Field of the Invention

The invention relates to bundle heat exchangers comprising assemblies (which may or may not be designed as built-in elements) formed of deflection surfaces and directing sections in the outer chamber.

Background Information

Since conventional bundle heat exchangers are usually made of a metallic material, we often refer to deflection panels rather than deflection surfaces. In this description, however, the term deflection surfaces is used to make it clear that their applicability is not limited to heat exchangers made of a metallic material.

The bundles can consist of tubes through which a heat exchange medium (for example a heating or cooling medium which heats or cools the product circulating in the outer chamber) is directed. Instead, however, other heat exchange elements combined into bundles, such as electric heating rods, electric heating coils and the like, can also be used. For the sake of simplicity of illustration, the terms "tubes" or "tube bundles" will be used hereafter, although after what has been said it should be understood that other extended heat exchange elements such as heating rods are also meant.

SUMMARY

The usual design of deflection panels or deflection surfaces serves as a flow guide by guiding the flow of fluid in the outer chamber partly transversely and partly parallel to the tubes. These metal sheets have bores corresponding to the tube spacing, are perpendicular to the tubes and have segment-shaped windows for the axial passage of fluid. Other known embodiments consist alternately of discs and rings. They are installed as standard in turbulent (low-viscosity fluids) and laminar (viscous fluids) flow. For further functional and structural details, reference is made to the VDI Heat Atlas (6th edition), sections Gg5 and Ob7. These deflection surfaces improve heat transfer thanks to the more or less pronounced crossflow to the tubes, but they do not cause any mixing of the fluid. This applies in particular in the case of laminar flow of viscous fluids. As these materials have lower heat transfer coefficients as a result of their properties, they should be guided around the tubes (VDI Heat Atlas, section Ob4). In the case of viscous media that have to be cooled or heated, viscosity can change significantly with temperature. Partial flows that run through a different temperature-time history (flow paths) ultimately have very different properties. This applies in particular to viscosity. Without constant mixing, preferred paths and dead zones develop, known as maldistribution. This can lead to complete failure of the heat exchanger, but also to poor product properties. The problems are similar when the heat exchanger is to be used as a polymerization reactor or for other exothermic reactions with viscous, liquid substances, cf. for example Chemical Engineering & Technology (Chem Eng. Technol.) 13 (1990), pp. 214-220. Here, too, differences in turnover and viscosity lead to maldistribution. Similar problems occur in tube-bundle heat exchangers, in which viscous solutions partially evaporate and viscosity increases sharply in the process.

Many static mixers such as X mixers (SMX, SMXL) or helical mixers (Kenics mixers) are preferably used with laminar flow in double jacketed tubes to improve heat transfer, mixing and residence time distribution at the same time, el Process Engineering 34 (2000) No. 1-2, pp. 18-21, There are narrow limitations to the scale-up of these devices because the ratio of heat transfer surface to product volume decreases as the tube diameter increases or, if the tube diameter remains the same, the pressure loss would increase rapidly as the product quantity increases. As a solution, attempts are being made to also use static mixers in the tubes of tube-bundle heat exchangers, wherein the product flows in the tubes. Mixing within individual tubes then still takes place, but the partial flows in the tubes are completely isolated from one another and different flow states and product properties can develop in the individual tubes. The result can again be pronounced maldistribution in the tubes with the effects described. The problem is made even worse by the higher pressure loss of the mixing elements. A further disadvantage with reactive products is the additional volume in the hoods of a tube-bundle device. There is little or no heat transfer in this space.

DE 28 39 564 C2 presents a device for heat transfer and static mixing. In this mixer-heat exchanger or reactor (known as an SMR reactor), the product also flows through a flow channel with tube bundles and around the tubes in the outer chamber. The tubes are bent in a meandering manner to form coiled tubes. The tubes are at 45° to the flow direction, cross one another and form a mixer structure. The individual tube coils are guided outwards through the channel wall into a collector. As a result, simultaneous mixing and good heat transfer in the outer chamber is achieved, but with a great deal of effort and many disadvantages. The mixing effect is less compared to the known mixer consisting of crossing sections and takes place only in one direction within a bundle or mixing element. For practical reasons, the tube bundles should be as long as possible. As a result, only a few bundles which are rotated 90° can be used in a flow channel. Each mixing element or coil bundle requires its own collector for the heat carrier medium. The pressure loss on the heat carrier side in the tubes is high because of the long coils and many tube bends. Different lengths of the coils lead to an uneven distribution of the flows on the heat carrier side and can in turn cause maldistribution on the product side.

An advantageous countercurrent flow of heat carrier medium and product or evaporation or condensation in the tubes is also not possible due to the construction of the bundles.

A further solution to the problem is sought in EP 1 067 352 B2. Mixing elements with crossing sections according to the known SMX structure are provided with bores corresponding to the tube spacing of a tube-bundle heat exchanger and the tubes are inserted through the sections. Linking the mixing structure with the tube arrangement restricts the freedom of tube spacing and size on the one hand and the mixer structure on the other hand. If the sections are not firmly connected to the tubes, this structure is also rather weak mechanically. In terms of process technology, this heat exchanger can be superior to the design according to the previous paragraph, but its manufacture is enormously complex and demanding.

One object of the invention is to create a tube-bundle heat exchanger, mixer heat exchanger or mixing reactor of the type mentioned at the outset which avoids the disadvantages of the prior art. This object is achieved by the characterizing features described herein.

The tube-bundle heat exchanger according to embodiments of the invention is particularly suitable for viscous products and can be manufactured very inexpensively. In the tube-bundle heat exchanger, products can be heated, cooled or evaporated and exothermic reactions can be carried out with simultaneous, intensive mixing. With low axial backmixing and low pressure loss, it has no moving parts. The formation of maldistribution is prevented and the fixtures are, if necessary, easily accessible for cleaning from the outside. The device is also very easily scalable. The arrangement and the number of extended (axially aligned) tubes (or other heat exchange elements/heat exchangers) through which there is a flow can be freely selected.

BRIEF DESCRIPTION OF DRAWINGS

The invention will be explained in more detail hereinafter with reference to the drawings.

DETAILED DESCRIPTION

Figure 1:
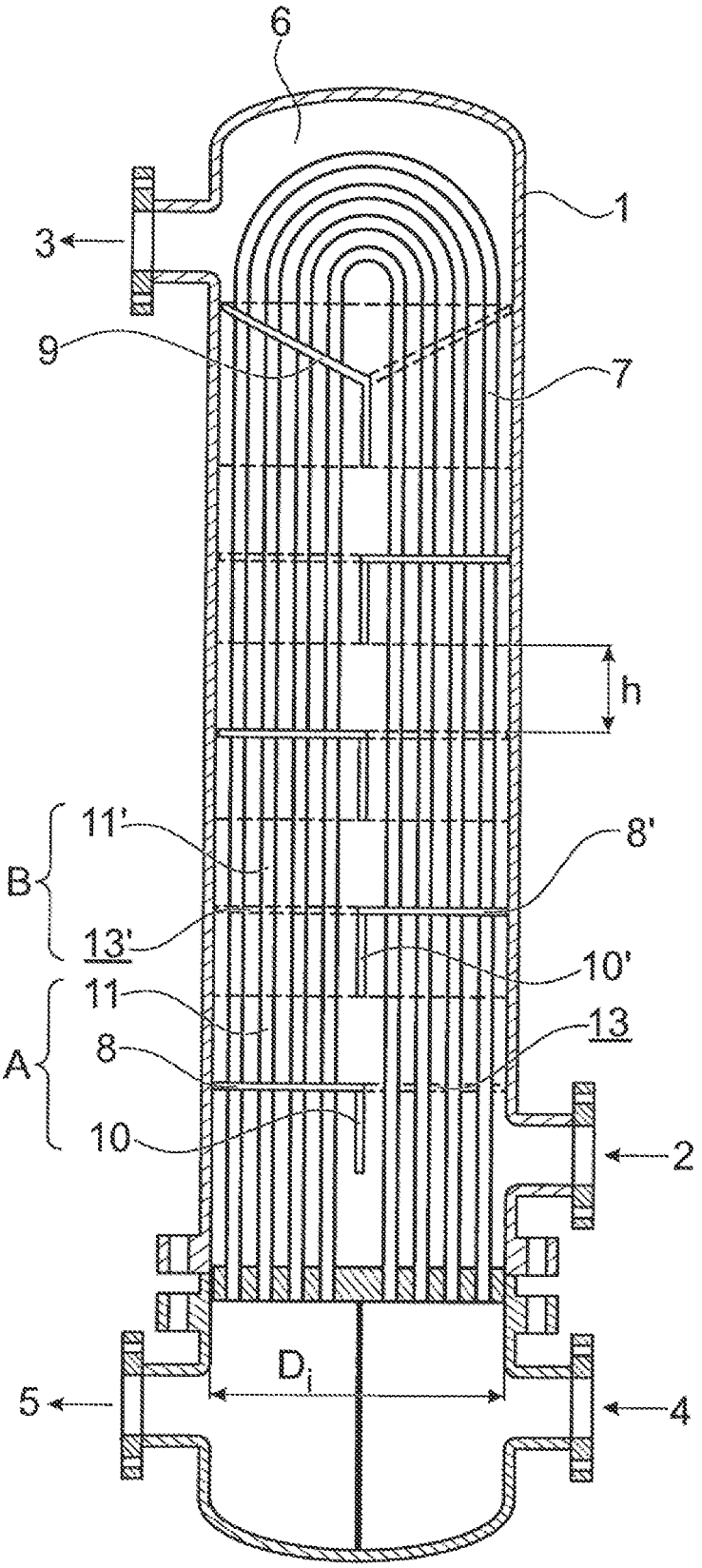
FIG. 1 is a longitudinal section through the tube-bundle heat exchanger according to the invention.

With general reference to the drawings, the product flows in the casing space of a tube-bundle heat exchanger known per se with an inlet 2 and an outlet 3 for the product in the outer chamber 6. An inlet 4 and an outlet 5 are provided for the heat carrier medium which flows in the tubes 7. According to embodiments of the invention, the deflection panels (or deflection surfaces) 8 that are usually present, which are perpendicular to the tubes or to the axis of the heat exchanger and have bores 7' for the tubes, are modified such that they leave two or more windows 12, 13 open for the axial passage of the product from the inlet side to the outlet side of the deflection surface. At least one directing section 10 or 11 is attached to the inlet side or the outlet side. These directing sections run parallel to the tubes and subdivide the cross section of the tube bundle into portions of approximately the same size. If necessary, the deflection surfaces can also be set at an angle to the heat exchanger or tube axis, cf. reference sign 9.

The directing sections 10, 11 on the inlet side and outlet side of the deflection surfaces are preferably at 90° to one another. The product flows divided by the directing section 10 on the inlet side in opposite directions, transversely to the tubes to the windows 12, 13; the deflection surface passes in the axial direction and opens onto opposite sides of the directing section 11 on the outlet side and is deflected in the direction of the directing section preferably by 90°. The flow direction of the partial flows transversely to the tubes on the outlet side is again opposite on both sides of the directing section 11. Deflection surfaces with windows and crossing directing sections each form a built-in element A or B. The directing sections 11, 10' of successive built-in elements (A, B) in the flow direction preferably cross one another at 90°. Closed partial surfaces 8, 8' and windows 12, 12' and 13, 13' of successive built-in elements A, B alternate.

In each built-in element, with laminar flow, there is a division into partial flows and mixing in such a way that in each built-in element, the number of layers at least doubles (with two partial flows or one directing section on the inlet side and on the outlet side) with simultaneous, intensive heat transfer. In the entire device, the number of layers formed increases exponentially from inlet to outlet with the number of built-in elements following one another in the flow direction. This process could be demonstrated on the basis of tests with rapidly hardening, tough polyester resin. In the case of a turbulent flow, the mixing is intensified by turbulence. The axial distance between successive deflection surfaces preferably corresponds to the height of two directing sections with no distances between them. The installation can, however, also take place with spacing or be shortened with directing sections pushed into one another. Instead of two windows with a directing section in between on the inlet side and on the outlet side, the deflection surfaces can also have a plurality of windows 25, 26, 27 and many pairs of directing sections (21, 22 and 23, 24). It is also possible that the number of directing sections on the inlet side and on the outlet side, or their height, is different. This increases the intensity of the mixing, but also increases the effort and pressure loss.

The flow path in the outer chamber is extended by the directing sections according to embodiments of the invention. This also increases the flow velocity around the tubes and the heat transfer. The intensive mixing prevents axial backmixing at the same time. The greater the number of successive assemblies/built-in elements in the heat exchanger and thus also the more streamlined the device, the narrower the residence time distribution will be, analogous to a cascade of stirred-tank reactors. In contrast to the fixtures according to embodiments of the invention, all previously known deflection panels (or deflection surfaces) for heat exchangers do not cause any mixing in the case of laminar flow or viscous products. Heat transfer is only improved as a result of the better crossflow to the tubes. The product flow is only diverted, but not divided and mixed.

FIG. 1 shows, by way of example, built-in elements A, B according to an embodiment of the invention made up of a deflection surface and associated directing sections in a U-tube heat exchanger with an extendable tube bundle. The casing 1 of the device is shown axially cut open a little in front of the center or in front of the outlet-side directing section 11 of a built-in element, while the built-in elements are shown in the view. A built-in element consists of closed partial surfaces, windows and associated directing sections on the inlet side and on the outlet side. The built-in elements can be loosely or wholly or partially firmly connected to the tubes by soldering, welding or gluing. The individual parts of a built-in element are also at least partially connected in this way.

In a further embodiment, as is customary with normal deflection panels, the fixtures are connected to one another and to the device by holding rods. It is also possible to manufacture sub-elements, including a directing section and closed partial surfaces, from sheet metal by flexing. The arrangement shown with U-tubes is only an example. Of course, the built-in elements are also suitable for all other tube-bundle heat exchangers, such as those with fixed, straight tubes and tube sheets or for multi-thread devices. Device cross sections that are not circular (e.g. square or rectangular) would also be possible. For the heating of liquids, electric heating rods or heating coils can also be used instead of tubes with a heat carrier medium.

Figure 2:
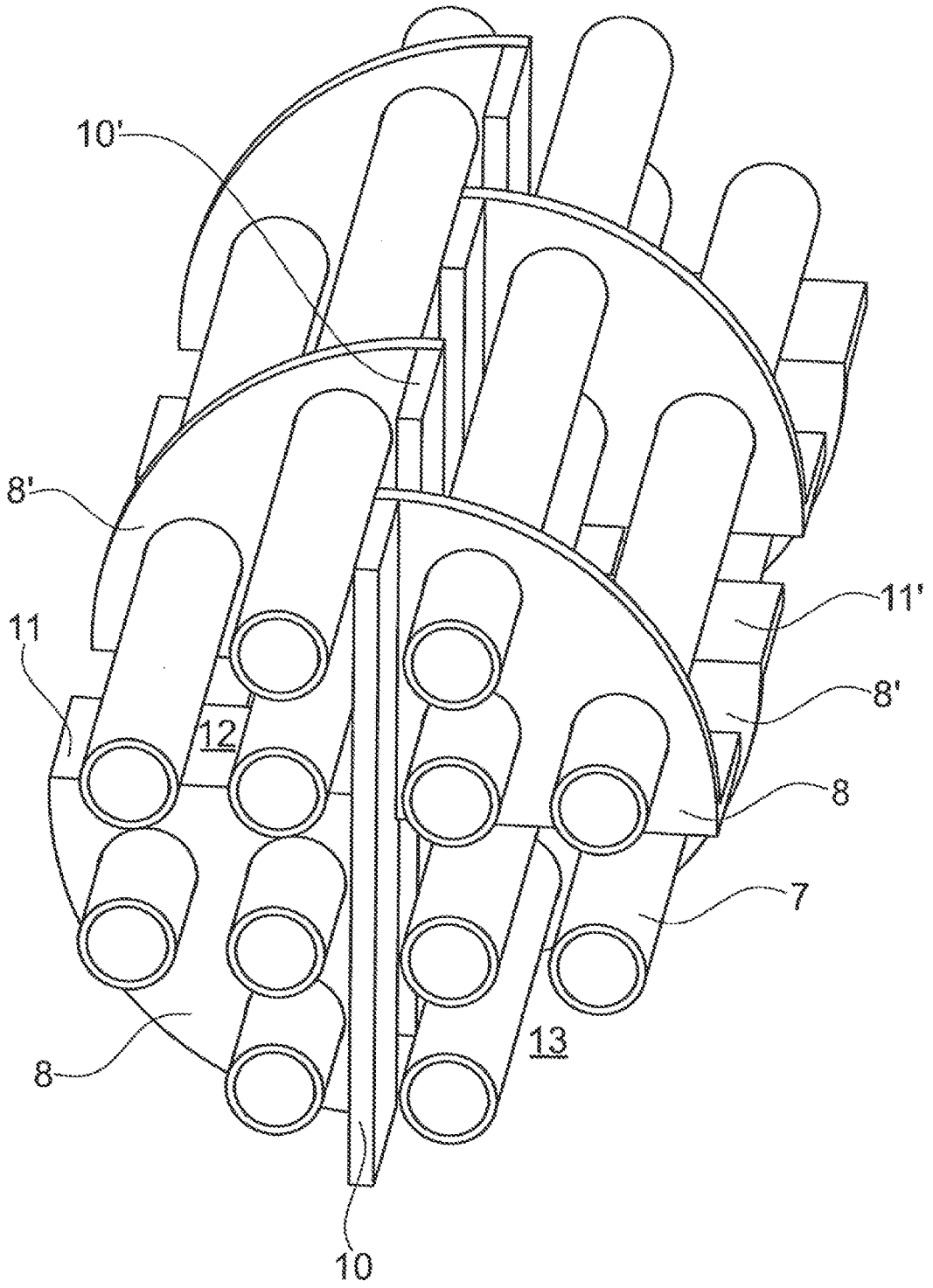
FIG. 2 is a perspective view of the tube-bundle heat exchanger.

FIG. 2 shows a three-dimensional representation of a bundle of tubes 7 with built-in elements according to an embodiment of the invention which comprise windows 12, 13, closed partial surfaces 8 and directing sections 10, 11. Closed partial surfaces and windows of successive built-in elements each cover one another and successive directing sections preferably cross one another at an angle of 90°.

Figure 3:
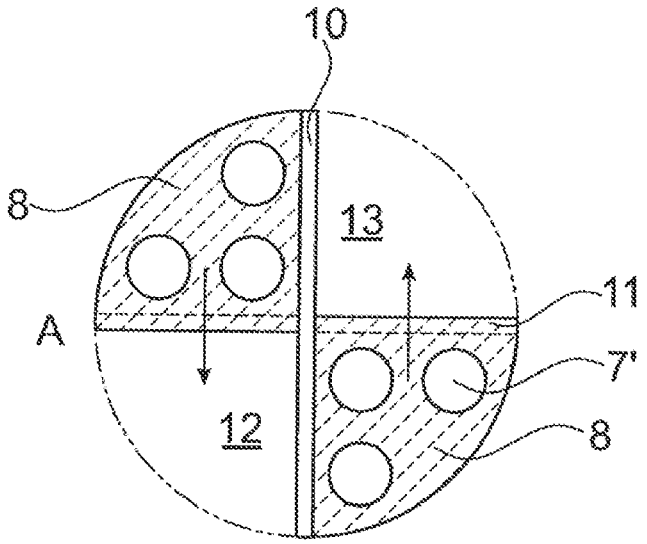
FIG. 3 is a view of the inlet side of a built-in element according to FIG. 1.

FIG. 3 shows a view of the inlet side of a built-in element A according to an embodiment of the invention with a deflection surface 8 and two directing sections 10, 11 as well as two windows 12, 13 and bores 7' in the closed partial surfaces for the tubes. The surface area of the window normally corresponds approximately to the closed partial surface. However, it is also possible to make the windows much smaller or in a different shape, such as slots or bores, in order to generate special flow effects or an additional pressure loss or to prevent the formation of strands.

Figure 4:
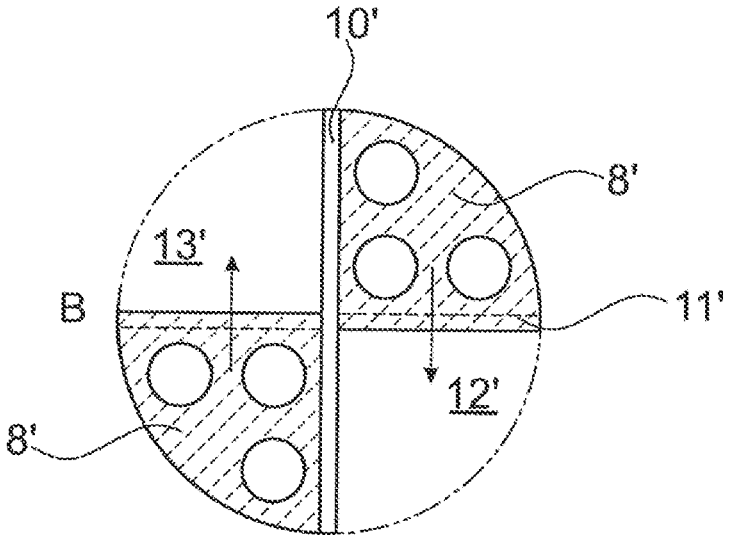
FIG. 4 is a view of the inlet side of a built-in element following in the flow direction.

FIG. 4 shows the view of the inlet side of a built-in element B according to an embodiment of the invention following in the flow direction with a deflection surface 8' and two directing sections 10', 11' as well as two windows 12', 13' and bores 7' for the tubes. The closed partial surfaces and the windows are offset in relation to the preceding built-in element shown in FIG. 3.

Figure 5:
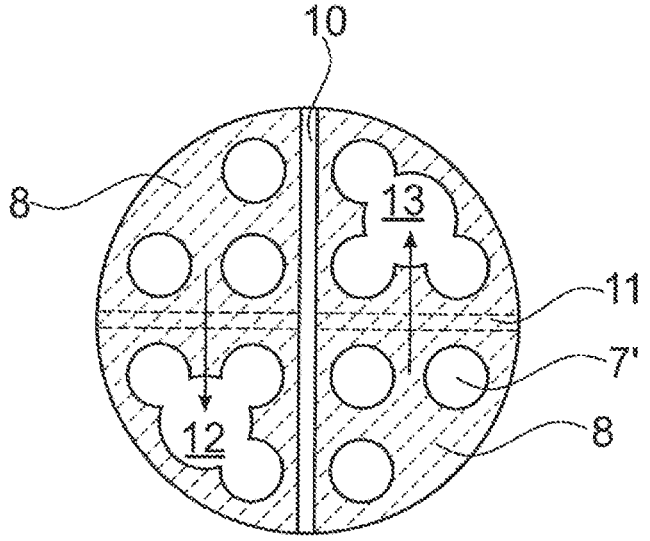
FIG. 5 is a view of the inlet side of a built-in element in an alternative embodiment.

An alternative embodiment is shown in FIG. 5. It is a view of the inlet side of a built-in element according to an embodiment of the invention comprising a deflection surface 8 with bores 7' for the tubes and two directing sections 10, 11 as well as two windows 12, 13, wherein the windows have a substantially smaller surface area than the deflection surface and are any shape.

Figure 6:
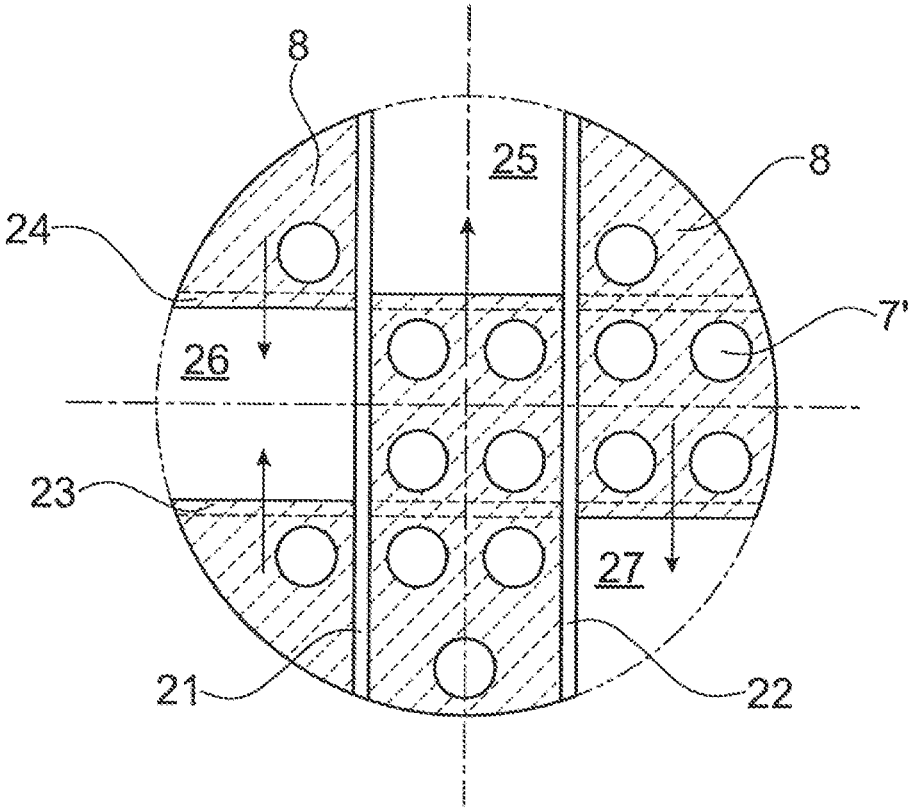
FIG. 6-8 show further embodiments of the inlet side of a built-in element.

FIG. 6 is a view of the inlet side of a further built-in element according to an embodiment of the invention with a deflection surface 8 and four directing sections 21, 22, 23, 24 as well as three windows 25, 26, 27 and bores 7' for the tubes.

Figure 7:
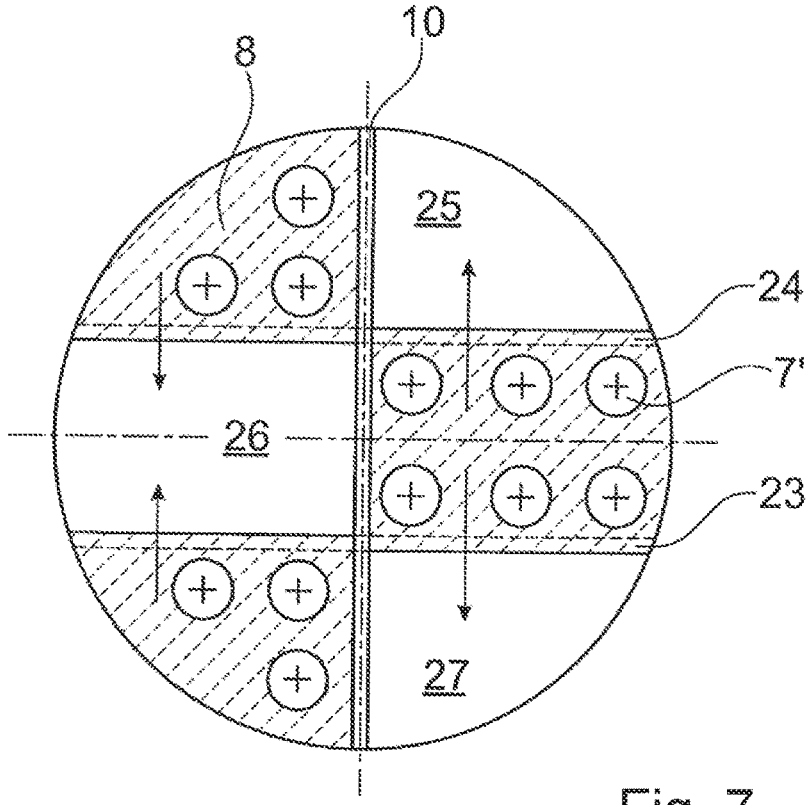
Figure 8:
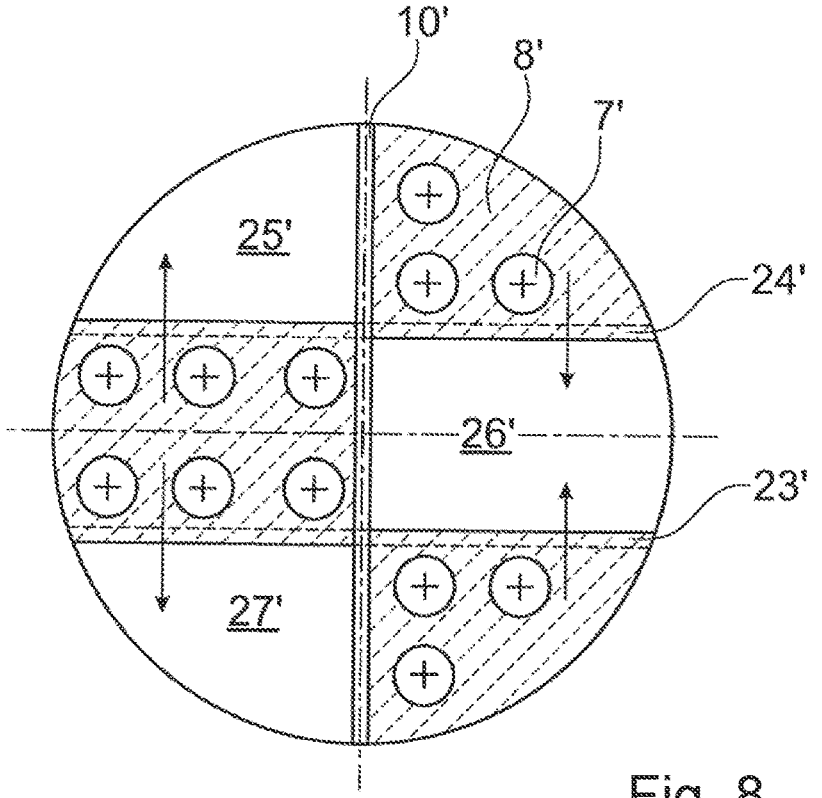

FIG. 7 is a view of the inlet side of a built-in element according to an embodiment of the invention with a deflection surface 8 and with only one directing section 10 on the inlet side, two directing sections 23, 24 as well as three windows 25, 26, 27 and bores T for the tubes, FIG. 8 is a view of the inlet side of a built-in element according to an embodiment of the invention, which follows a built-in element in front thereof according to FIG. 7, with a deflection surface 8' and with only one directing section 10' on the inlet side, two directing sections 23', 24' as well as three windows 25', 26', 27' and bores 7' for the tubes. The windows are each offset from the windows with respect to the element according to FIG. 7, so that no direct, axial passage is possible if the elements are arranged one after the other in the flow direction.

Figure 9:
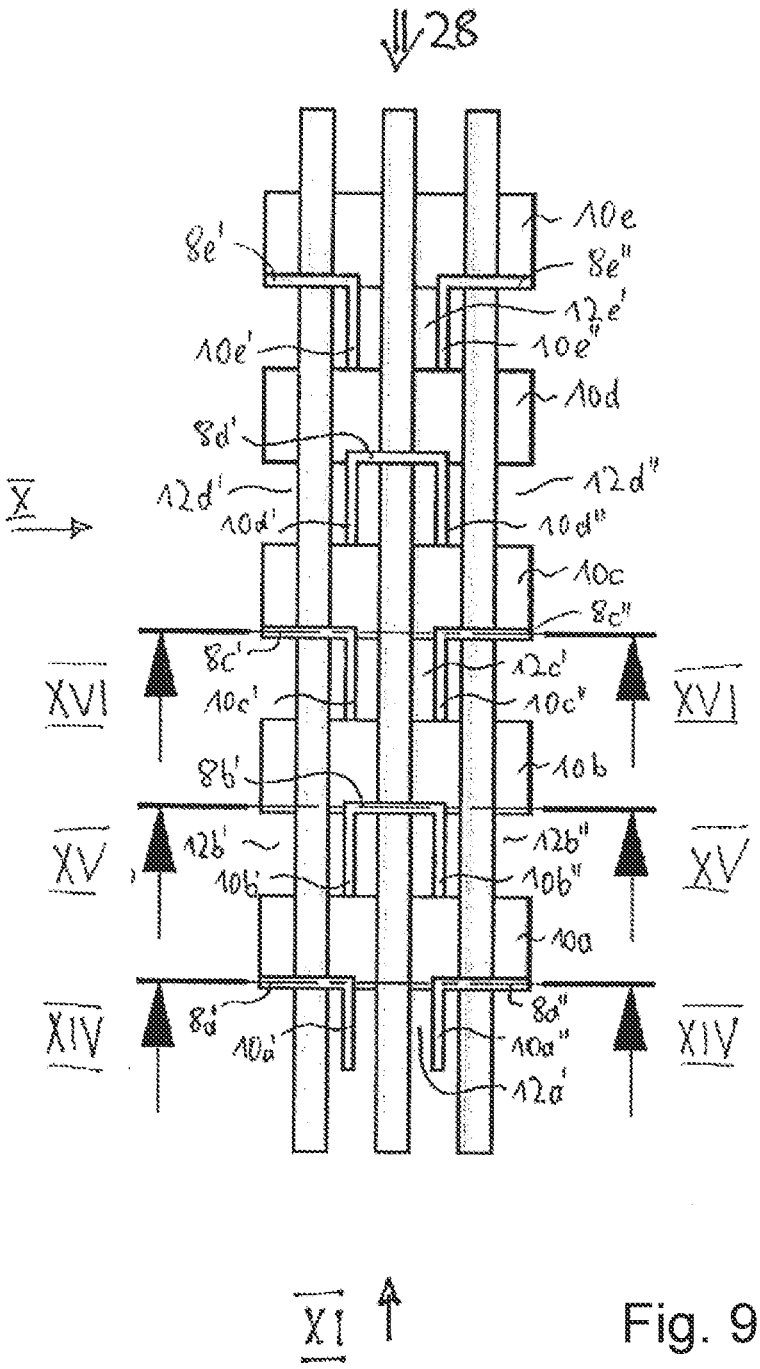
FIG. 9-16 are various views and sections of an embodiment of the invention.

A detailed illustration of a variant of the invention based on FIGS. 7 and 8 is shown in FIGS. 9 to 17, which are not all shown on the same scale. The casing 1 has been omitted for reasons of illustration. FIG. 9 is a plan view of the tube bundle of the heat exchanger with the deflection surfaces, windows and directing sections according to the invention. The heat exchange medium (heat or coolant) flows in the direction of arrow 28 through the tubes. The directing sections are provided here with the reference signs 10*a* to 10*e*. Further directing sections 10*a'*, 10*a"* to 10*e'*, 10*e"* are located at an angle of 90° thereto, wherein the directing sections are each connected at right angles to the deflection surfaces 8*a'*, 8*a"*; 8*b'*; 8*c'*, 8*c"*; 8*d'*; 8*e'*, 8*e"*. The reference signs 8*a'*, 8*a"*; 8*b'*; 8*c'*, 8*c"*; 8*d'*; 8*e'*, 8*e"* denote partial surfaces which have openings or bores for tubes to pass through. The deflection surfaces are also interrupted by windows 12*a'*; 12*b'*, 12*b"*; 12*c'*; 12*d'*, 12*d"*; 12*e'*. The geometry of the deflection surfaces and the windows cut out therein alternate from deflection surface to deflection surface, as will be explained in more detail below.

Figure 10:
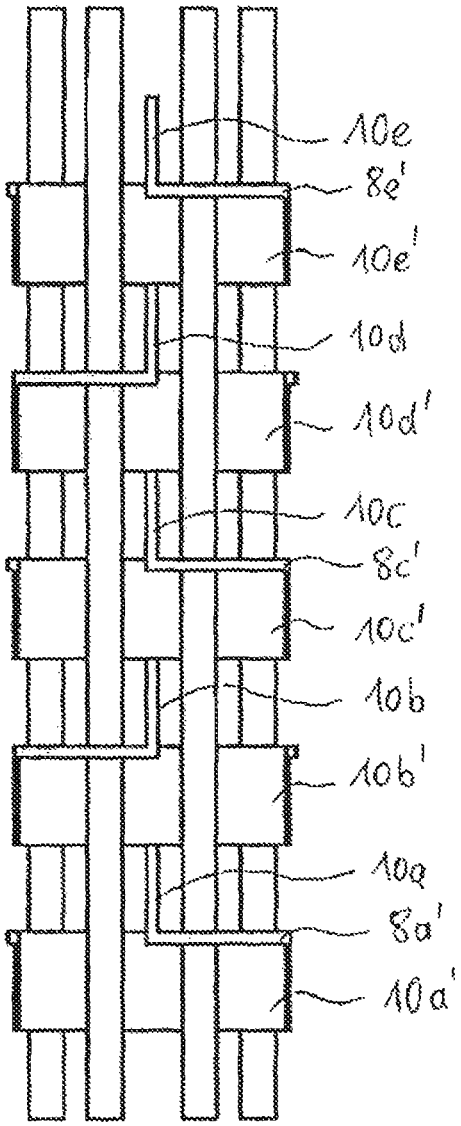
Figure 11:
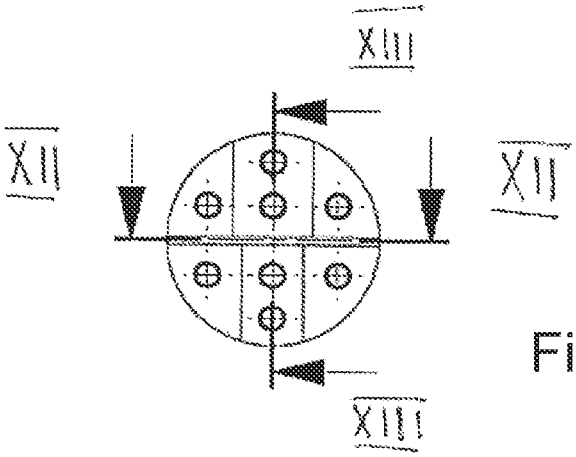
Figure 12:
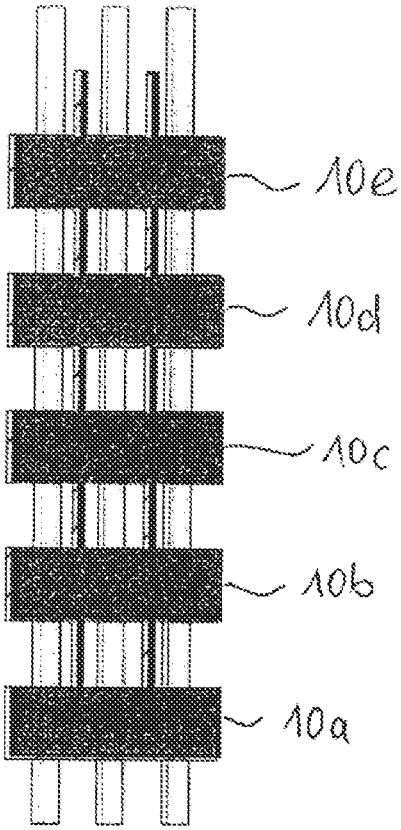
Figure 13:
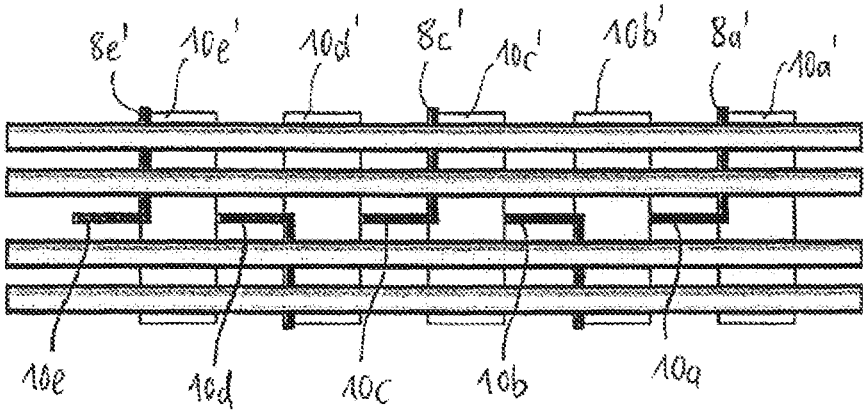

FIG. 10 shows the same structure as FIG. 9, but this time shown in the direction of arrow X in FIG. 9. FIG. 11 is a plan view from the direction of arrow X1 in FIG. 9 with the marked sections XII-XII and XIII-XIII, which can be found in FIGS. 12 and 13, respectively.

Figure 14:
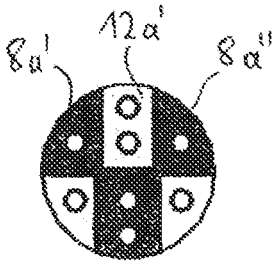
Figure 15:
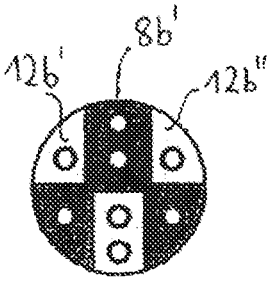
Figure 16:
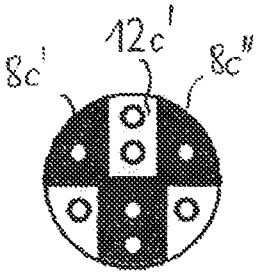

In FIG. 9, sections XIV-XIV, XV-XV and XVI-XVI are also indicated. These sections are shown in FIGS. 14, 15 and 16, respectively. The sections show the successive deflection surfaces, which each have a complementary geometry to the preceding (or next) deflection surface in order to ensure optimal mixing of the product to be mixed. Thus, the deflection surface shown in FIG. 14 has (covering) partial surfaces 8*a'*, 8*a"* which divert the flow of the product and have only one bore for a tube. In between there is the (open) window 12*a'*, which does not offer any resistance to the flow and is only crossed by two tubes. The deflection surface shown in FIG. 15 is complementary to the deflection surface of FIG. 14, i.e. it has partial surfaces where windows were located in the deflection surface of FIG. 14 and windows where partial surfaces were located in the deflection surface of FIG. 14. The reverse applies in each case to the lower half of the deflection surfaces, which are not provided with reference signs. The product flowing through the mixer/heat exchanger is thus forced to take a different path from deflection surface to deflection surface, which results in optimal mixing of the fluid. The third section according to FIG. 16 again corresponds to that of FIG. 14.

Figure 17:
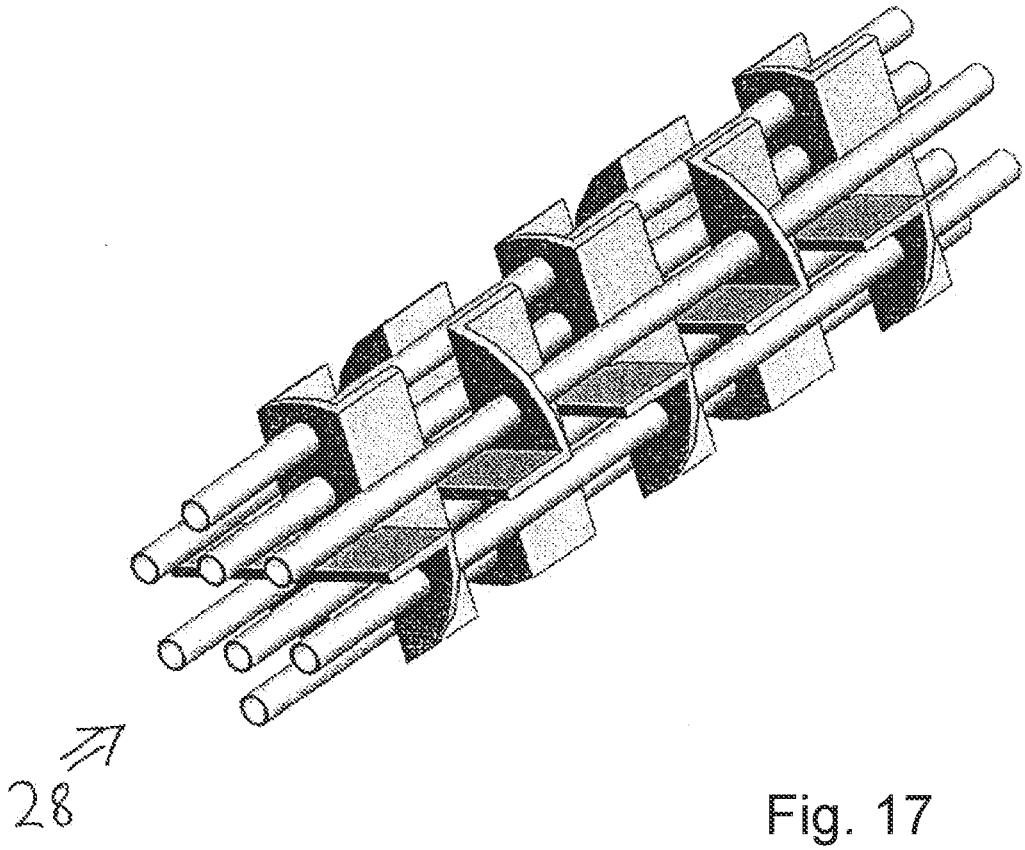
FIG. 17 is a perspective view of the embodiment according to FIGS. 9-16.

For further illustration, FIG. 17 is finally a perspective illustration of the tube-bundle heat exchanger described with reference to FIGS. 9 to 16, wherein arrow 28 indicates the flow direction of the product (cf. FIG. 9). For the sake of clarity, this figure is not provided with reference signs, but these are derived from FIGS. 9 to 16.

The assemblies or built-in elements and their components such as deflection surfaces and directing sections can be manufactured from steel and welded in a manner known per se. However, cast parts can also be used. Finally, manufacturing from plastics is also possible, for example by injection molding or by means of additive manufacturing such as 3D printing.

The invention claimed is:

1. A bundle heat exchanger for delivering or dissipating heat and simultaneous mixing of product flow, comprising:

a bundle of at least two extended heat exchange elements;

an outer chamber;

an inlet opening;

an outlet opening, an inlet and an outlet arranged such that a product flow in the outer chamber is capable of flowing from the inlet opening to the outlet opening; and at least two fixed assemblies each comprising: at least two partial deflection surfaces and at least two windows, each of the at least two windows disposed in one of the partial deflection surfaces or between the partial deflection surfaces, each of the at least two windows leading from an inlet side to an outlet side of the at least two partial deflection surfaces, each of the partial deflection surfaces for each of the at least two fixed assemblies including a first directing section and a second directing section that are parallel to the extended heat exchange elements, the first directing section attached on the inlet side of the at least two partial deflection surfaces and the second directing section attached on the outlet side of the at least two partial deflection surfaces, the at least two partial deflection surfaces each including at least one portion not provided with a window leading from the inlet side to the outlet side of the deflection surface, the at least one portion having one or more bores or openings for passage of the extended heat exchange elements according to spacing thereof in the bundle, and the first directing section on the inlet side and the second directing section on the outlet side crossing one another at an angle of 90°.

2. The bundle heat exchanger according to claim 1, wherein the bundle heat exchanger has a circular cross section.

3. The bundle heat exchanger according to claim 1, wherein an axial distance between successive ones of the deflection surfaces corresponds to a height of two directing sections of the first directing section and the second directing section with no distances between the two directing sections.

4. The bundle heat exchanger according to claim 1, wherein the at least two windows are arranged on opposite sides of the first directing section or on opposite sides of the second directing section.

5. The bundle heat exchanger according to claim 1, wherein:

the at least two fixed assemblies include a first fixed assembly and a second fixed assembly, the deflection surfaces for the first and second fixed assemblies stand transversely to the extended heat exchange elements, and the deflection surfaces for the first and second fixed assemblies are arranged one behind an other in a flow direction, the windows of the deflection surface of the first fixed assembly alternate with the at least one portion of the deflection surface of the second fixed assembly not provided with windows, and the at least one portion of the deflection surface of the first fixed assembly not provided with windows alternates with the windows of the deflection surface of the second fixed assembly.

6. The bundle heat exchanger according to claim 5, wherein:

the deflection surfaces of the first and second fixed assemblies each include the first directing section and the second directing section, and the first directing section or the second directing section of the first fixed assembly crosses the first directing section or the second directing section of the second fixed assembly at an angle of 90°.

7. The bundle heat exchanger according to claim 1, wherein a cross section of the bundle is divided into approximately equal-sized partial surfaces by the first and second directing sections of the assemblies.

8. The bundle heat exchanger according to claim 1, wherein of at least one of the deflection surfaces, portions provided with the at least two windows and the at least one portion not provided with windows are approximately a same size.

9. The bundle heat exchanger according to claim 1, wherein for at least one of the deflection surfaces, portions provided with the at least two windows leading from the inlet side to the outlet side are smaller than the at least one portion not provided with windows leading from the inlet side to the outlet side.

10. The bundle heat exchanger according to claim 1, wherein for each of the first directing section and the second directing section of at least one of the at least two fixed assemblies, a height is at most 0.25 times an inner diameter of the at least one assembly.

11. A method comprising:

operating the bundle heat exchanger according to claim 1 for heat transfer with viscous products.

12. A method comprising:

operating the bundle heat exchanger according to claim 1 as a reactor in exothermic or endothermic reactions.

13. The bundle heat exchanger according to claim 1, wherein a number of the first directing section and the second directing section is different on the inlet side and on the outlet side.

14. The bundle heat exchanger according to claim 1, wherein a height of first directing section and the second directing section is different on the inlet side and on the outlet side.

* * * * *